US008087687B2

(12) United States Patent
Murdock

(10) Patent No.: US 8,087,687 B2
(45) Date of Patent: Jan. 3, 2012

(54) ADJUSTABLE ADULT MOBILITY DEVICE

(76) Inventor: Janet Murdock, Canyon Country, CA (US)

( * ) Notice: Subject to any disclaimer, the term of this patent is extended or adjusted under 35 U.S.C. 154(b) by 232 days.

(21) Appl. No.: 12/587,901

(22) Filed: May 11, 2009

(65) Prior Publication Data

US 2010/0219617 A1 Sep. 2, 2010

Related U.S. Application Data

(63) Continuation-in-part of application No. 11/538,328, filed on Oct. 3, 2006, now abandoned.

(60) Provisional application No. 60/724,190, filed on Oct. 6, 2005.

(51) Int. Cl.
*A61G 5/08* (2006.01)
*A61G 5/10* (2006.01)

(52) U.S. Cl. ..... 280/642; 280/647; 280/650

(58) Field of Classification Search ..... 280/642, 280/647, 650, 250.1, 304.1, 657, 47.25, 47.38, 280/47.4

See application file for complete search history.

(56) References Cited

U.S. PATENT DOCUMENTS

| | | | | |
|---|---|---|---|---|
| 5,370,408 | A * | 12/1994 | Eagan | 280/33.994 |
| 7,185,910 | B2 * | 3/2007 | Beauchesne et al. | 280/650 |
| 7,243,938 | B2 * | 7/2007 | Stamps et al. | 280/304.1 |
| 7,520,519 | B2 * | 4/2009 | Smurthwaite, Jr. | 280/250.1 |
| 7,614,641 | B2 * | 11/2009 | Hartenstine et al. | 280/642 |
| 7,862,069 | B2 * | 1/2011 | King | 280/650 |
| 7,871,100 | B2 * | 1/2011 | Chen et al. | 280/642 |
| 2004/0129306 | A1 * | 7/2004 | Jefferson | 135/96 |
| 2006/0237932 | A1 * | 10/2006 | Moore, II | 280/47.41 |
| 2010/0301574 | A1 * | 12/2010 | Derks et al. | 280/47.4 |

* cited by examiner

*Primary Examiner* — Drew Brown

(74) *Attorney, Agent, or Firm* — Ken Dallara; Law Office of Ken Dallara

(57) ABSTRACT

An adjustable multipurpose adult mobility device is herein disclosed which includes improvements over prior art including ride cushioning, improved braking and includes a movable frame adapted for use by a person to assist in ambulatory movement, and a canopy that is positioned substantially above and carried by the movable frame. A flexible shield extends downwardly from the front portion of the canopy to at least partially cover a front portion of the movable frame. Such coverage effectively protects a passenger from the environment or potential inclement weather.

33 Claims, 6 Drawing Sheets

DETAIL 3A

DETAIL 4C

DETAIL 4B

ADJUSTABLE ADULT MOBILITY DEVICE

Claiming priority from: Prov App No. 60/724,190, filed Oct. 6, 2005 and application Ser. No. 11/538,328 Currently Pending filed Oct. 3, 2006

FIELD OF THE INVENTION

The present disclosure relates to an Adjustable Multipurpose Adult Mobility Device, whereby Adult persons who are of limited ambulatory means either through handicap, weakness, balance or neurological issues, are able to be moved comfortably or able to move themselves in more comfort than the prior art discloses and practices. This device due to it's self-controlled movement prevention features also serves as a device to assist those who need a steady platform in which to lean against whilst standing or to aid in their own ambulatory process.

BACKGROUND OF THE INVENTION

The current selection of flexible mobility devices for adolescents and adults having limited mobility, vitality, balance issues, or neurological difficulties, is limited. An overwhelming number of Americans, over 54 million as of the last Census report, suffer from some form of limited mobility. There are over 15 million who, alone, use walking canes. These numbers are sure to escalate as a growing percentage of the population reaches retirement age. By 2030, approximately twenty percent of the entire population will be 65 years old or older. Additionally, nearly one in a dozen adolescents has some form of physical or mental disability that precludes easy, pain free ambulatory transportation. Thus, there is already a large need to have access to easily transportable devices for aid in mobility of every aspect of life. While the selection of strollers for babies and infants may be abundant, the market for adult strollers has yet to develop. Targeting individuals in the above market is critical to adequate health care, especially considering the target consumer is increasing in percentage population.

Individual consumers in the targeted adult stroller market might specifically include persons afflicted with restricted ambulatory movement and their corresponding caregivers. On a broader scale, corporations comprising the $1.1 trillion United States medical industry also fall into the targeted market. Hospitals, health care facilities, and nursing homes are all potential consumers as these institutions strive to provide maximum comfort and flexibility for patients of all ages and sizes. These institutions have an abundant access to wheel chairs and fully motorized scooters. But, wheel chairs and fully motorized scooters are often heavy, obstructive, and require special facilities and retrofitted vehicles to transport equipment. This adjustable adult mobility device is specially designed to eliminate the downfalls of these devices by being lightweight, versatile, and collapsible for easy storage and transportation. There is also a market for those adults that do have limited mobility and wish to have control over their daily lives without the need for additional help. Flexibility and versatility allows these passengers to go more places and thus have fuller life experiences while riding in comfort.

Ambulatory injuries impair mobility and hence preclude enjoyment of many of life's activities. Such injuries might include spinal cord damage, stroke, advanced osteoporosis, and hip or joint replacement. While individuals may not be fully dependent on a wheelchair, getting from one place to another can be time-consuming, difficult, and frustrating without the aid of a mobility device. This is often the case in instances where an individual is required to walk or stand in one place for an extended period of time. Limited movement not only frustrates the person with the disability, but can often instill frustration with companions, caregivers, or other individuals having an intimate relation with the disabled person. Other types of chronic illnesses such as heart conditions, cancer, and other degenerative diseases may also make physical transportation difficult. Balance and coordination issues are also brought on by such conditions as head trauma, Parkinson's disease, Alzheimer's disease, Meniere's disease, dementia, or even middle ear disturbances. Individuals afflicted with such ambulatory restrictions will find relief in an adult stroller in their everyday lives as a mobility aid.

Prior art is replete with examples of strollers which are used for children and in limited ways adults. In particular, there is prior art that has shown the use of shock absorbing technologies. Basically the current state of the art in absorbing or cushioning the shocks of the road are focused either on the drivetrain or wheel subsystems, such as U.S. Pat. No. 4,455,031 issued to Hosaka on Jun. 6, 1984 or Published Application 2007/0114754 published May 24, 2007 by Santos etal, which focuses on the absorbing the bumps in the road through the wheels suspension system, or the seat itself, such as in Published Application 2006/0016648 to Lin published on Jan. 26, 2006. Problems are that shock absorbers mounted in the vertical plane are responsive to the shock and rely on the strength of the spring to support the weight of the occupant. A spring stiff enough to provide support to an adult is going to be so stiff as to transmit a significant amount of vibration directly to the spine or back of the user. It is an object of this invention to provide a shock absorbing system whereby the bumps and potholes of the road are not transmitted directly to the rider and especially to the riders back, regardless of the riders weight.

Another issue with the current state of the art is the absence of variable braking systems that incorporate a disc system of braking that provides instant selective braking rather than the pin and spoke arrangement of U.S. Pat. No. 5,370,408 issued to Eagan on Dec. 6, 1994 and most current infant or baby strollers with a foot operated flip brake, which provides either a complete retardation of movement by locking the wheels or complete free-wheeling. It is an object of this invention to provide a braking system which is at a rest position engaged by friction between a disc brake rotor and a set of brake shoes at an infinitely number of locations about said rotor, and is capable of selective reduction of said friction by application of pressure.

Thus, there exists a significant need for an adult mobility device capable of transporting an adolescent or adult having limited mobility, balance issues, or neurological difficulties. Such an improved stroller should include a lightweight and/or foldable construction for easy movement, a means for protecting a passenger from the environment, capacity for transporting medical devices or other goods, and a mechanism to control the stroller when left unattended with a passenger inside. The present invention fulfills these needs and provides further related advantages.

It is the principle object of this invention to provide an adult mobility device which combines the comfort of a cushioned ride which is adaptable to the needs and requirements of the adult rider. Another object of this invention is to provide a mobility device that has a braking system that is controllable by the occupant or the caregiver. It is another object of this invention to allow the rider of this device to be able to self-propel themselves or be provided mobility by the caregiver.

SUMMARY OF THE INVENTION

Herein disclosed is a specially designed assistive mobility device configured for use by adolescents and adults. This adult mobility device includes four wheels and a frame manufactured from a light weight material such as heavy gauge nylon or vinyl, composites, aluminum, or other suitable material. This frame would ideally be tubular in design to facilitate a lighter weight, greater strength and provide a means to conceal control cables inside of the frame to prevent breakage, wear and snagging The durable, yet flexible design allows the adult mobility device to be used in parks, stores, amusement parks, and around town. The adult stroller provides adolescents and adults a means for a safer, easier, and comfortable mode of transportation. Adult stroller passengers will be able to once again go shopping, see movies, and enjoy parks, even in inclement weather. The stroller is easily storable, has a variety of safety features, is perfectly adjustable, and is an ideal replacement for wheel chairs and fully motorized scooters.

The adult mobility device frame is versatile and foldable for easy storage. In general, the frame is supported by a series of four wheels. Two wheels in the front are fixed while the two rear wheels swivel. Although, a variety of wheel combinations are possible. Mobility device's movement is controlled by a person through use of a rear handle that curves back similar to a shopping cart. An embodiment will provide the person to control the movement of the mobility device through his own means, either through the application of force onto the front wheels by their hands or by an extended arm which can ratchet the front wheel in either direction using the concept found in socket wrenches. Also integrated into the frame design is a brake bar located on each side of the rear handle. The brake bar runs adjacent down the side of the frame and connects to a brake unit. When resting, the brake unit engages and locks at least one of the mobility device wheels. This safety feature prevents inadvertent movement or accidental rolling of an unattended stroller. A person, such as a caregiver, attempting to move the mobility device need only pull the brake bar to disengage the brake unit. An embodiment of this invention is having the person be able to move the device themselves and as such, the user is equipped with their own brake bar to release the brake pressure on the device. After stopping and releasing the brake bar, the brake unit reengages at least one of the wheels to again prevent movement.

The adult mobility device also includes a front weather shield. A combination of the canopy and the front shield protects an adult mobility device passenger from the environment—including the sun and inclement weather. A section of the front shield is manufactured from a clear plastic material to allow a passenger to see out. The bottom portion of the front shield may be made from any weather resistant material, such as nylon. While the front shield may be designed in many different sizes, the front shield should ideally be long enough to completely cover a passenger's legs and feet. The front shield may substantially cover and connect to a front portion of the frame to further protect the passenger from the outside environment. For storage, the front shield may be folded under the canopy or folded above the canopy or the support structure and canopy can be removed completely. Additionally, a rear shield (not shown) can be stored underneath the canopy in a pocket, and deployed in a similar manner to the front shield. The rear shield is used to substantially cover the rear side of the adult mobility device frame. When the front and rear shields are both deployed, a passenger is completely enclosed within the adult mobility device and thus protected from the environment.

In addition to protection from the environment, the adult mobility device also includes a variety of comfort options. A seat support incorporates several padded seat designs, adjustable head rests, and neck support options. A shock absorbing system is incorporated which is obliquely aligned to provide for maximum comfort. For persons with specific or particularly painful back problems, an optional detachable and adjustable lumbar support device may be mounted to the seatback. Persons dependent upon respirators or other respiratory aid devices have the option of storing an oxygen tank or other medical equipment in specially designed seatback pockets. The seatback is adjustable and configured to recline into a variety of positions to maximize comfort. Armrests reside on each side of the frame and may incorporate a basket-type cup holder for storing beverages. An optional tray attaches over the armrests. Furthermore, the foot rest folds up to enable a passenger to stand in close proximity to the seat when sitting down and standing up. A flexible storage compartment resides in back of the footrest and is integrated into the base of the adult mobility device frame. This storage compartment compacts when the adult mobility device frame is collapsed. An optional wire or mesh basket can be secured to the handle for shopping or additional storage.

All of the features are combined along with the significant ability to present a device that is collapsible and is lightweight enough to be transportable without special equipment or attachments.

The above and other objects and the nature and advantages of the present disclosure will be more apparent from the following detailed description of certain specific embodiments thereof, taken in conjunction with the drawings, wherein:

BRIEF DESCRIPTION OF THE DRAWINGS

The accompanying drawings illustrate the invention. In such drawings.

DETAILED DESCRIPTION OF THE PREFERRED EMBODIMENT

Figure 1:
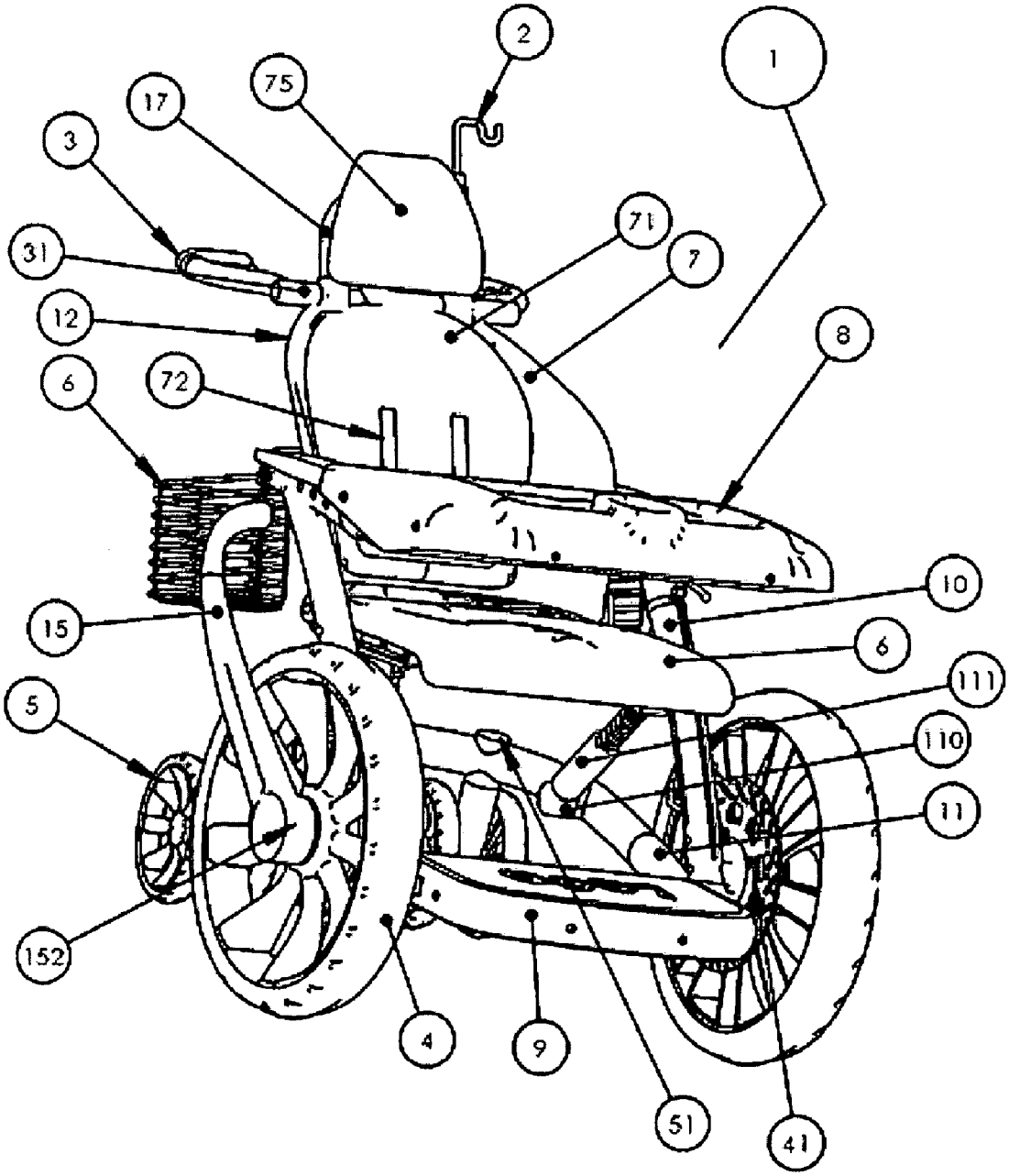
FIG. 1 is a frontal elevation perspective of the adult mobility device where the front canopy and it's associated support structure has been removed for clarity.

As shown in the exemplary drawings for purposes of illustration, the present disclosure for an adult mobility device is referred to generally by the reference numeral 1.

Device 1 comprises of 7 main component structures, 1) Frame, 2) seating means, 3) tray, 4) wheels and power and braking systems, 5) rear mounted accessories, 6) ride smoothness means and 7) canopy. These will be explored in detail in the following paragraphs.

Figure 2:
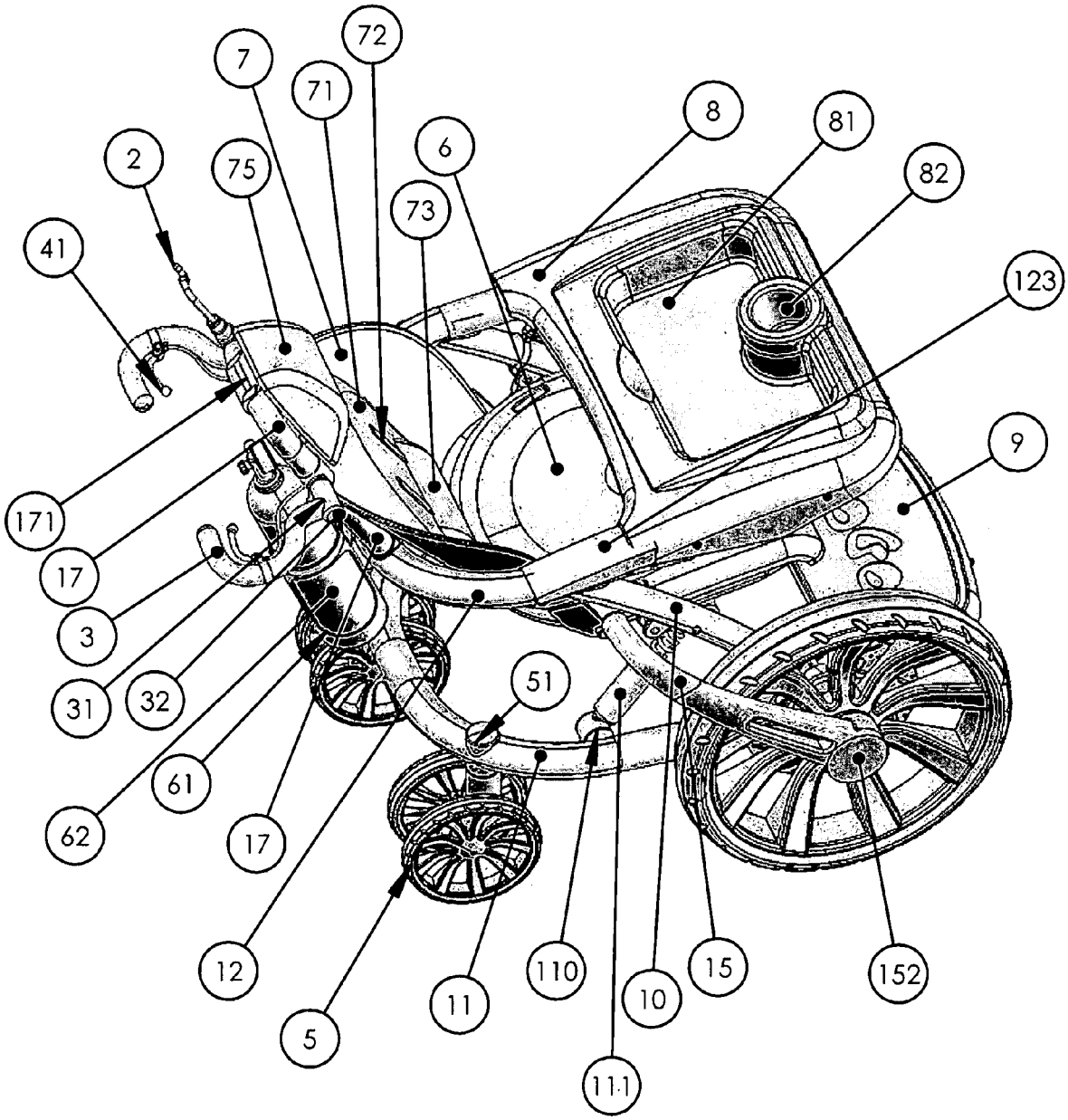
FIG. 2 is an oblique view from a higher elevation perspective which details the structure of the device along with the seat back and tray, where the front canopy and it's associated support structure and the rear mounted baskets have been removed for clarity.

The frame is comprised of a parabolicly or "U" shaped lower frame section 11 and a parabolicly or "U" shaped upper frame section 12 being joined by transverse frame member 10. All frame sections are generally constructed from a lightweight and durable material such as heavy gauge nylon, fiberglass, composites, heavy gauge vinyl, aluminum, or other suitable materials meeting such criterion and would be tubular in nature. Lower frame 11 is a "U" shaped member and is the platform upon which are mounted the mobility means, shock absorbing member attachment 110 and foot rest 9. In this invention, the mobility means consists of two front wheels 4 and at least one rear wheel 5. Front wheels 4 are located in the front of the device, front being described as the direction in which the rider is facing during the principal amount of time while in the device. Rear wheel 5 can be single or dual in nature as shown in FIG. 2. In this invention, the best mode for practicing this invention was having two sets of rear wheel 5 which are swivelably mounted on the rear portion of the "U" shaped lower frame 11. Rear wheels in this invention are mounted onto shaft 51 which transects the frame and are attached whereby the wheels are capable of pivoting or swiveling allowed the caregiver more easier steer the device. Having the turning wheels smaller than the front wheels and being closer to the source of propulsion allows for less energy expended to maneuver the device, in contrast to most wheelchairs where the larger tires are located in the rear and the turning or steering wheels are located at the front of the wheelchair. This makes it difficult for the caregiver to turn the chair in tight circumstances. In this invention, the front wheels 4 are larger than the rear wheels.

Figure 4:
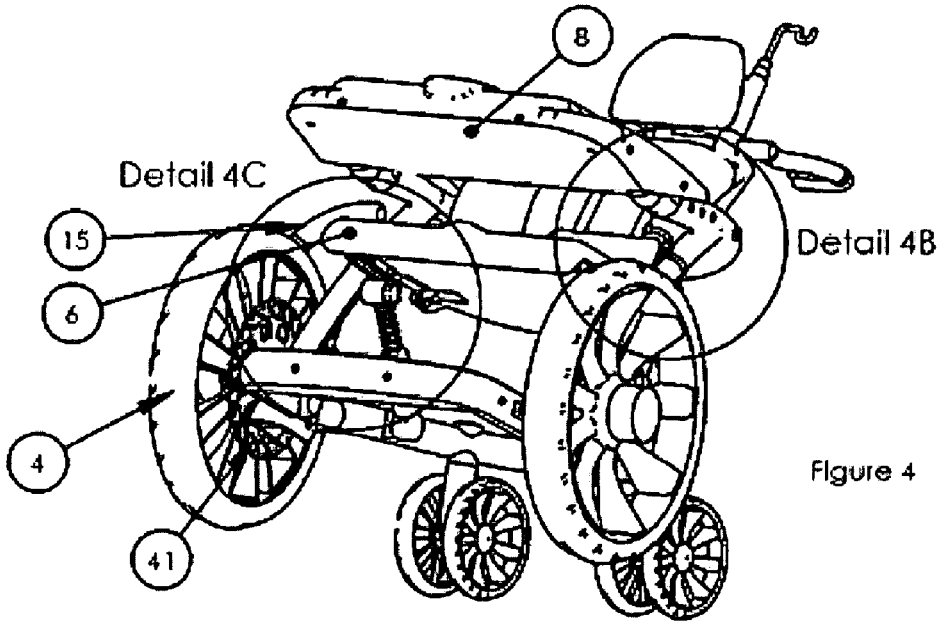
FIGS. 4, 4B and 4C are frontal underside oblique perspective views of the mobility device detailing the shock absorber and seat adjustment along with the power arm embodiment where the rear mounted baskets and canopy structure is removed for clarity.
Figure 4C:
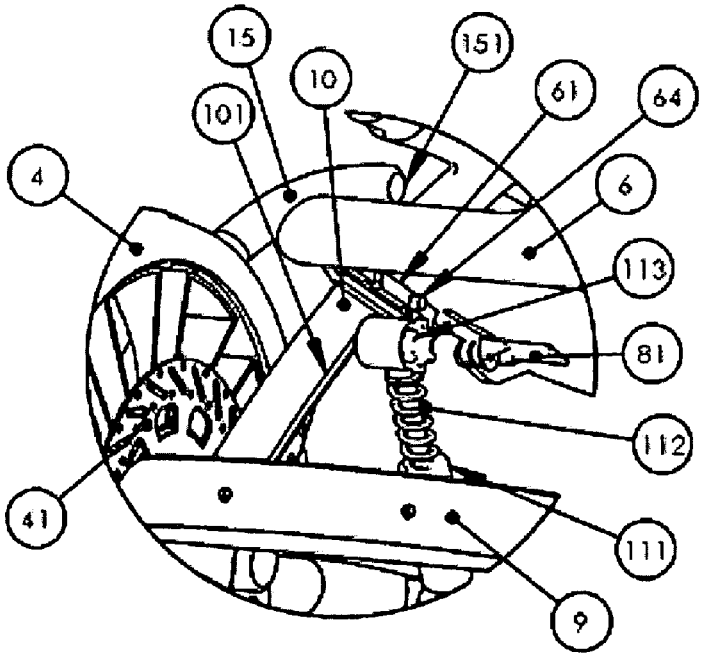

Front wheel 4 is rigidly attached to frame section 11 independently and at opposite open ends of the "U" shaped section 11, said attachment 45 allowing the wheels 4 to rotate freely thereabout the axis of rotation of attachment 45 and each wheel 4 is independent of the other. Positioned attachment 45 and wheel 4 is braking means 41. In this invention, a disc brake rotor 44 is used, which is vented and has multiple cutout circumscribed thereabout the surface allowing for a reduction of weight while maintaining a size necessary to accommodate a set of brake pads 43 to apply a sufficient amount of pressure. A larger surface area of the rotor will aid in the smooth acceleration of the device as the moment of inertia of the larger disk creates a slower acceleration which is more comfortable for the rider and also becomes inertia so that the caregiver needs less energy to propel the device once in motion. The width and composition of said front wheels 4 are such as to provide a smooth comfortable ride and enable the device to be mobile over a wide range of surfaces, especially softer materials such as sand and loose dirt. Front wheels 4 can be equipped with a surface or fitted with an extra circular extension (not shown) that will enable the rider to move the device without the aid of a caregiver. An embodiment of this invention is the addition of power bar 15 as seen in FIG. 1 and FIG. 4C. Power bar 15 acts with ratcheting hub 152 much with the same mechanical action of a socket wrench. In these Figures, the power bar 15 is located on the right side of the device but location is dependable on the rider's preference. Teeth within hub 152 engage with the power bar when the power bar is extended and cause the wheel 4 to turn as the power bar is moved back to the original position. The rider reciprocates bar 15 up and back ambling the device forward or rearwards depending on whether biasing button 151 is engaged or not.

Motion resistive means 41 is disclosed as that means which will prevent the motion of device 1 absent it's positive displacement relieving such resistance to motion. In this invention, motion resistive means is disclosed as a braking system 41 which is designed so that maximum closure of the brake pads 43 upon the rotor 44 is accomplished when the device is at rest and the caregiver nor the rider is applying any force to the brake release mechanisms 42 or 46. Brake release means 46 is located inside of and along caregiver's handle 3. In this invention, brake release mechanisms are caliper style brake levers which when activated cause a tightening of the caliper cables thereby releasing the pressure of pad 43 upon rotor 44. It is an object of this invention to create a brake release mechanism that is capable of providing a range of pressure release, rather that a distinct engage/disengage of a pin and socket style of brake. It is within the scope and spirit of this invention that other means of controlling the release and regulation of the amount of release upon the pad 43 can be developed or are currently designed. Pads 42 are caused to have pressure upon rotor 44 through either manually adjusted spring tension or hydraulic fluid pressure. The braking means 41 can also be controlled through a rider controlled release in an embodiment best shown in FIGS. 4B and 3A. The rider is capable of using rider brake release 42 in the same manner as the caregiver. It is shown that the release 42 is on the left side of the rider, but this location is transferable to either side and any location. It is preferable that release 42 is on the side opposite of power bar 15, should that embodiment be present as well.

Foot rest 9 is pivotivally attached about the ends of lower frame 11. The pivoting of the foot rest allows for retraction when the user is wanting to stand, using the device for support and also pivots out of the way when the device is collapsed. Foot rest 9 can be padded to increase the comfort of the rider or can be removed completely based upon the desires of the rider. The pivoting of foot rest 9 is restricted so that it can not be more than parallel with lower frame member 11 and the ground, yet is capable of at least 180 degrees of freedom when pivoted rearwardly.

Located between where shaft 51 transects the frame 11 and the open ends of the "U" frame are attached shock absorber attachment means, located along the interior side of frame 11, each attachment have been placed on either side of the interior of the "U" shaped frame 11, each one equally distant from the open ends of said frame 11. In this invention, the shock absorber attachment means are cylindrical posts 110 that interrelate to the hollow bore located at the distal end of absorber body 111. Attachment means can widely vary and the only criterion required is that the post and bore arrangement be such as to allow the shock absorbing means to rotate thereabout as necessary without impingement.

Figure 6:
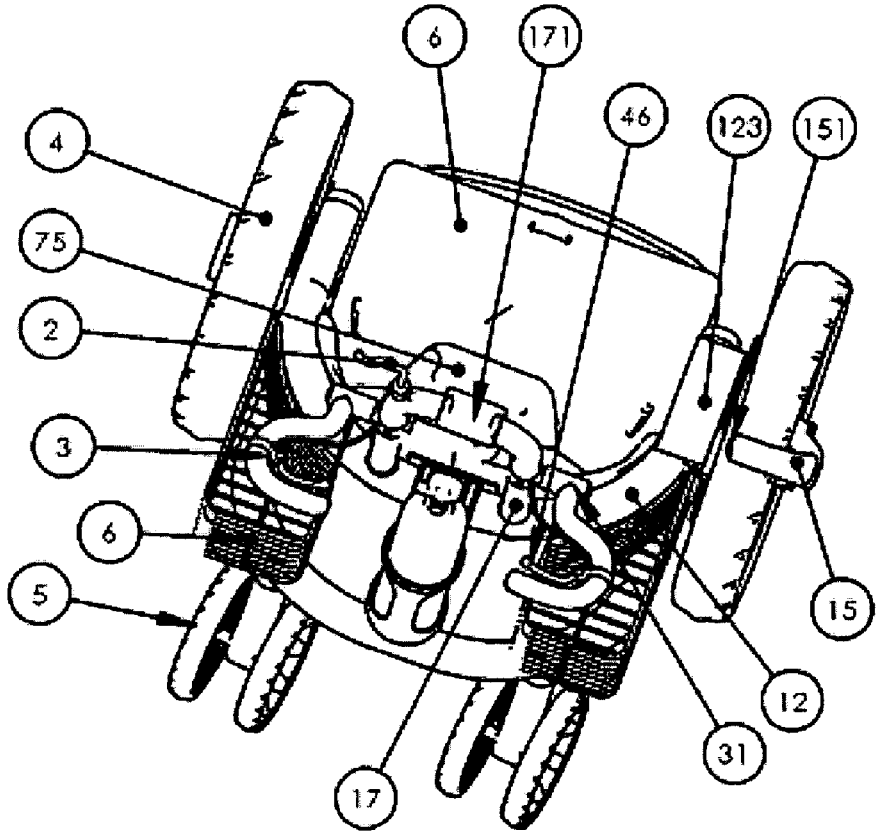
FIG. 6 is a upper perspective view detailing the rear components of the device; and, FIG. 7 is a perspective view of an adult mobility device in the collapsed state where the left front wheel is removed for clarity.

Upper Frame 12, which is also "U" shaped, is created at the level normal to the riders natural elbow height, and serves as the member the upholds the seat back 7, head rest and handle assembly 17 and 3, the material containment means 6, the medical aid holder 126, armrests 123 and tray 8. Tray 8 adjustably slides into the open portion of the "U" shaped frame 12, where detented spring engaged balls are located through adjustment means 121 as detailed in FIG. 3A. Tray 8 is completely detachable as seen in FIG. 6. FIG. 2 shows an embodiment of the flat tray common with this style of wheelchair. FIG. 2 shows that tray 8 can be embodied to have food recess well 81 and recessed cup holder 82, as examples of the multitude of options available to comfort and entertain the rider. The tray 8 also serves as a containment means for the rider in a manner similar to that of the tray in a baby's high chair. Tray 8 can serve as an arm rest and storage container for items such as the canopy 13.

Figure 3:
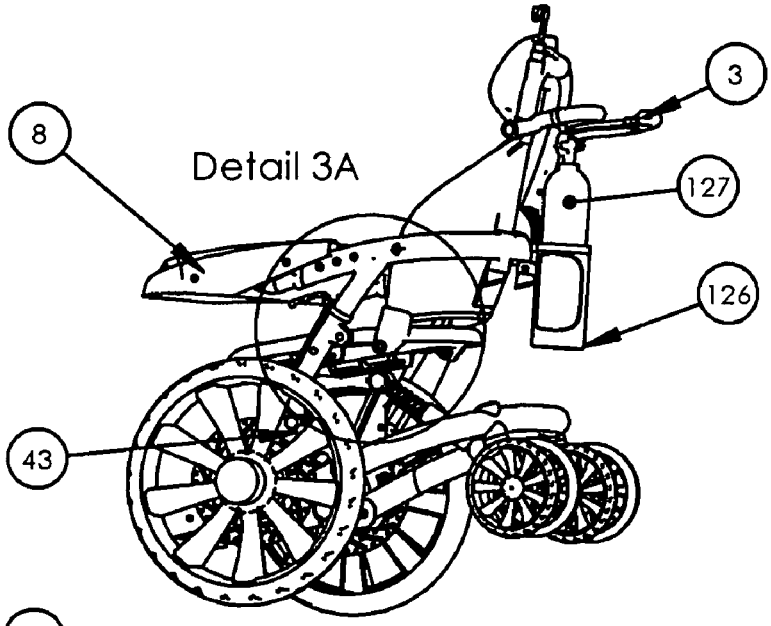
FIGS. 3, 3A and 3B is a left side elevation perspective with a detail section 3A, detailing the seat adjustment means, shock absorbers, tray adjustments and user brake release where the rear mounted baskets and canopy structure is removed for clarity and a closeup of the shock absorber head in FIG. 3B.
Figure 7:
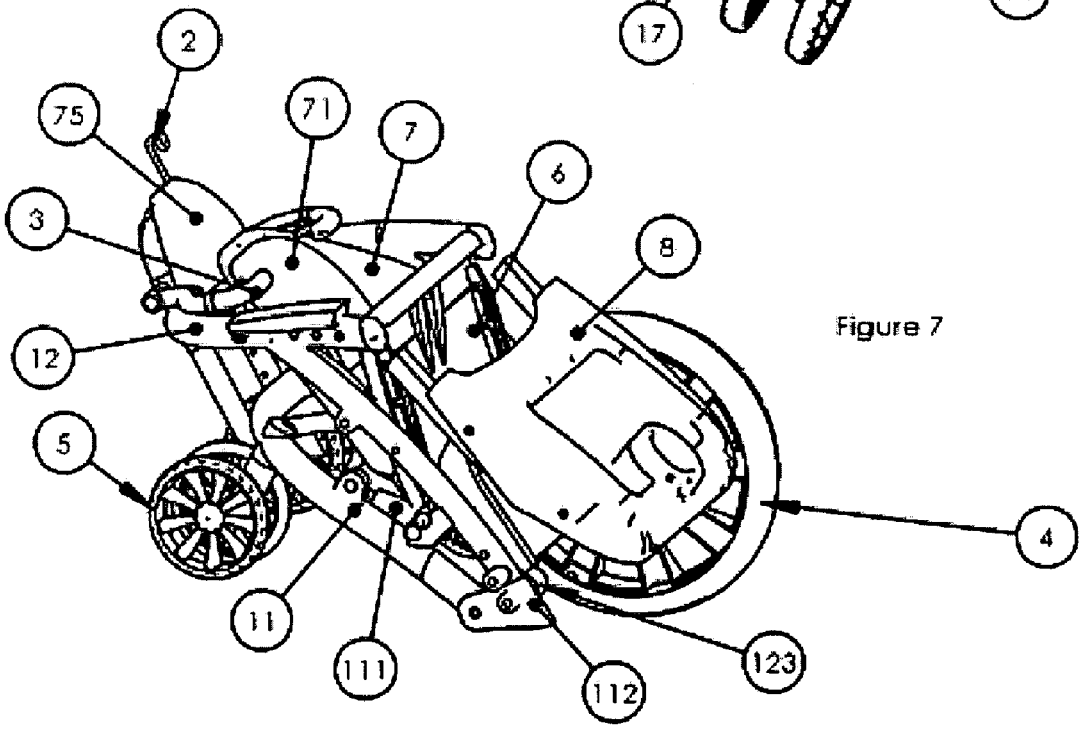

FIG. 2 shows armrest 123 located on the right side arm of member 12 but can be located on either or both side. Immediately interiorly adjacent to armrest 123 is material containment means 6. In this invention, open wire baskets are located on either side of and are contoured to match, seat back 7. There is a myriad of possibilities where one can envision particular styles and types of material containment means, and this invention only discloses one, wire baskets. Centered on the exterior of the vertex of the "U" shaped member 12 is the medical aide holder 61. This holder 126 is shaped to accept an oxygen bottle 127 in this invention but this holder 61 can be designed to fit a variety of aids, whether for respiratory devices or monitors, this invention embodies an oxygen bottle for use of the rider, or for the caregiver for that matter. Holder 126 is designed to keep bottle 127 in a nearly perpendicular plane as shown in FIG. 3 but other device may require a different orientation. An additional feature is the catheter bag holder 129, as people who are generally in need of this device are usually incontinent requiring a means for them to be comfortable and sanitary, Head rest assembly 17 protrudes in a vertical plane centered about the vertex of the "U" shaped member 12, and handle assembly 3 are attached to head rest assembly 17 through handle attachment 31. Handle attachment 31 allow handle 3 to be rotatably attached to assembly 17, rotating about the central axis of attachment 31 providing the caregiver with a preferred angle of use, while also allowing the handles to rotate nearly 180 degrees from the in use position to the collapsed position as shown in FIG. 7. Head rest assembly 17 also provides for the placement of medical bag holder 2 at a position of greatest height, allowing the gravity feed of medications, food or liquids. In this invention, head rest assembly 17 has two posts creating a rectangular frame upon which the handle assembly 3, holder 2 and head rest attachment 171 are attached. One skilled in the art would recognize that other frame shapes or singular post design could be adapted to this application. Head rest 75 is detachably attached to head rest attachment 171 centered about the vertex of the frame 12. Handle assembly 3 also contains brake release mechanism 46 as seen in FIG. 2. The caregiver, through the natural position of their hands about the rounded part of the sickle shape handle 3, can easy manipulate the mechanism 46 which variably relaxes the pressure on the brake pads 42. As stated previously, handle 3 can be rotated throughout a range of motion about the axis of attachment 31, allowing for a comfortable angle which the caregiver creates as they amble the rider over various terrain. An embodiment includes a position control selector 32 which inhibits the rotation of the handle 3 about the axis of rotation, thereby preventing the over rotation of the handle during use.

Frame member 12 takes it's rearward shape from the contour of seatback 7 which is the shell upon which seatback cushion 71 is fitted. At the top portion of seatback 7, head rest 75 is centered thereupon and the lower portion of seatback 7 is pivotally attached to seat bottom 6 through the interface of seatback bracket 82 and seat bottom connector 81. Integral to cushion 71 are rectangular back slots 72 as detailed in FIGS. 1 and 2. The number of slots in this invention is two, but that does not limit their function, size, shape or function. The purpose of slots 72 is to facilitate the mounting of devices, cushions or other posture related items that will assist the rider in comfort. In this invention, lumbar support cushion 73 is fitted so that it's posts will fit through the slots for rearward attachment. Other cushions can include thoracic supports and pelvic and sacral bladders. It is the scope of this invention to include those therapeutic or support members, including braces, pillows, cushions and bolsters that are used to support and position the rider in greatest comfort, and allow the members a location where they can located and secured.

Figure 3A:
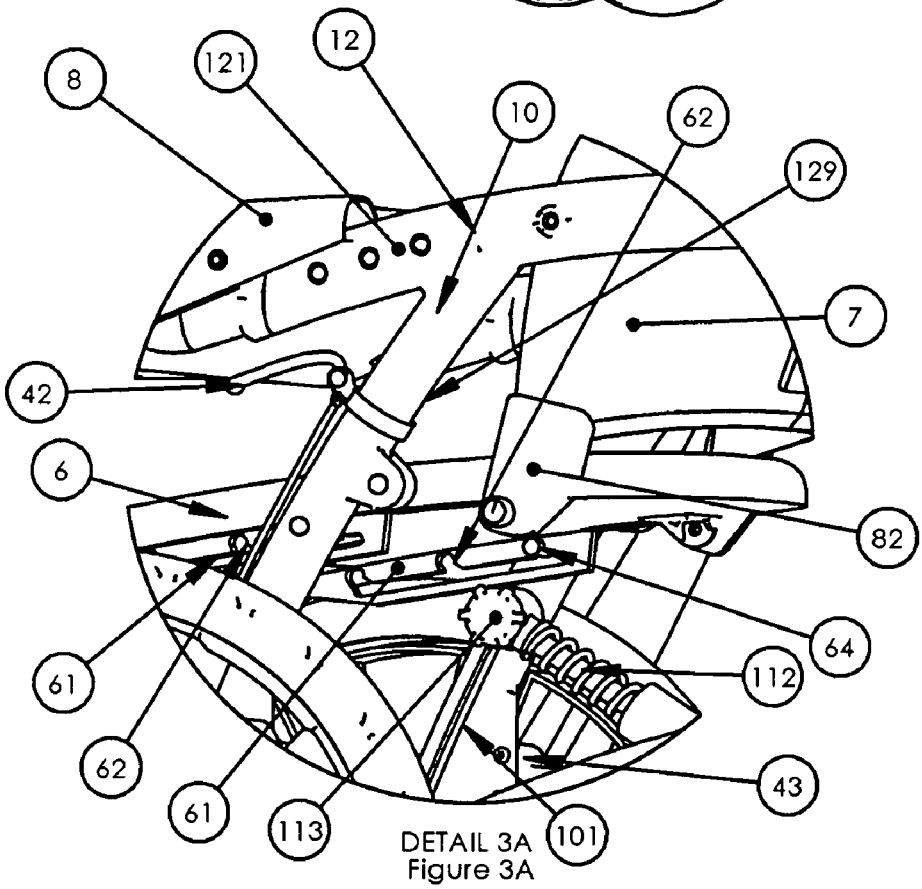
Figure 4B:
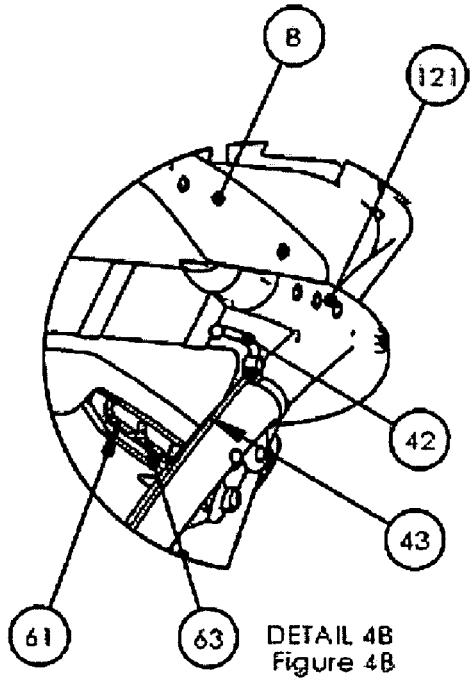

Transverse frame member 10 connects upper frame member 12 and lower frame member 11, through a permanently secure angled abutment between the proximal end of member 10 to upper frame member 12, as seen in FIG. 3A, and a pivoting bracket 112, as seen in FIG. 7, conjoining the distal end of member 11 to the ends of lower frame member 11. Transverse member 10 anteriorly contains post 64 and slot 101, as seen in FIG. 3A which function as the seat 6 adjustments, as they respectively interface with horizontal displacement rail 61 and shock absorber head pin 114.

Figure 3B:
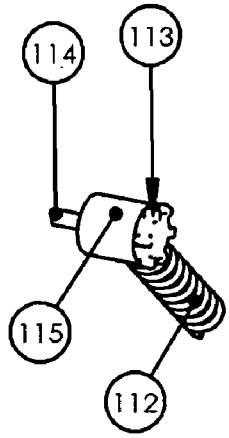

The ride comfort means consists of at least a pair of shock absorbing members consisting of shock absorber body 111 having a distal end rotatably attached to post 110. The proximal end of body 111 is terminated in shock head 115. Prior to the attachment of head 115 onto body 111, spring 112 is placed into the interior of body 111. Spring 112 must have the resiliency sufficient for the weight of the rider and the device, but not so much as to create a bumpy ride whereby the resiliency of the spring is not overcome by the weight of the rider. Head 115 contains slot pin 114 and adjustment knob 113 as seen in FIG. 3B. Slot pin 114 rides in the interior slot 101 of transverse member 10 which sets the height of the total chair. The user twists knob 113, loosening or tightening the interference between pin 114 and slot 101, allowing for the device 1 to pivot and collapse. It is critical that the angle of the ride comfort means not be perpendicular to the seat 6, as it will translate surface irregularities directly to the rider rather than the frame. The ride comfort means should be held at an oblique angle, preferably an acute angle between the lower frame member and the means itself. Horizontal displacement rail 61 is located on the left and right edges of the underneath side of seat 6, rail 61 interfacing with post 64 located on the anterior side of transverse member 10. Rail 61 contains 2 or more post capture slots 62. The user is able to lift the seat 6 and slide it either towards the front or rear of device 1 and capturing post 64 into one of slot 62, thereby adjusting the relation between seat 6 and seat back 7. The upper side of seat 6 can be cushioned and/or contoured for rider comfort as seen in FIG. 2. An embodiment includes the strap slots 69 in through the seat, whereby a strap can be included which would safely secure the rider into the device 1, said straps being similar to the seatbelts on cars.

Figure 5:
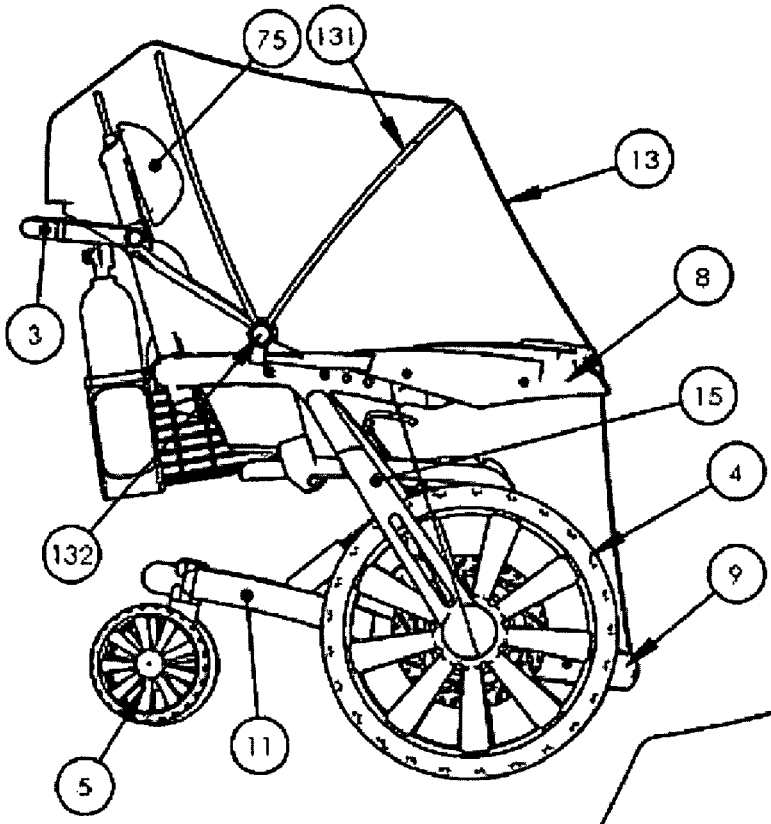
FIGS. 5 and 5A are a right side cutaway and a left side lower oblique views detailing the canopy covering the front of the device and details the support structure.
Figure 5A:
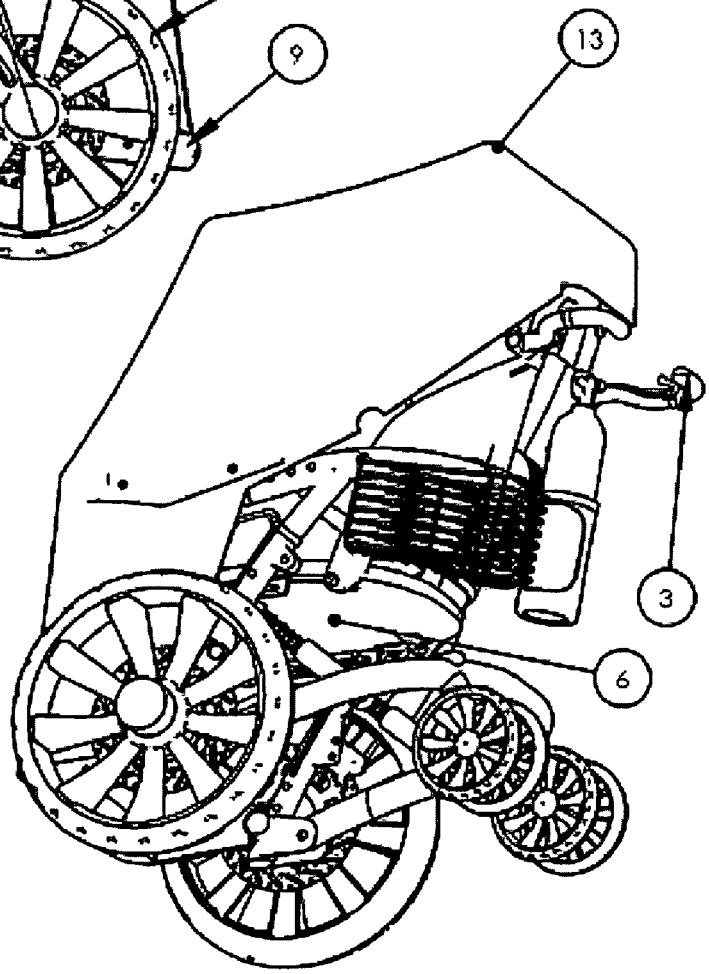

FIGS. 5 and 5A show the addition of a canopy 13 which extends over a frame that contains one or more canopy supports 131, said supports terminating in a frame support 132, which is attached to upper frame member 12. Canopy 13 is designed to protect the rider through inclement weather, and in this description extends all of the height of canopy supports 131, whereby the canopy extends to below the foot rest 9. Canopy 13 extends past the head of the rider extending to a point whereby the caregiver has access to handles 3. Canopy 13 is designed of a breathable fabric with clear viewing portals, yet sturdy enough not to be effected by wind and rain.

Device 1 is designed to be collapsible. FIG. 7 shows a collapsed device 1. The user releases the shock absorber head, allowing pin 114 to slide downwardly along slot 101. As transverse frame member 10 pivots about the end of lower frame member 11, the seat will pivot about the interface between post 64 and capture slot 62, and the footrest will pivot about it's connection 123 with lower frame member 11.

A variety of modifications and improvements to the adult mobility device of the present disclosure will be apparent to those skilled in the art. Accordingly, those skilled in the art will appreciate that such changes may be made without departing from the underlying principles of the present disclosure. The above-described disclosure is not intended to limit the scope of the invention. Accordingly, the scope of the present invention is determined only by the following claims.

What is claimed is:

1. An Adult Multipurpose Mobility Device for the ambulatory assistance of those who are unable to travel without support due to physical, age or psychological reasons comprising of the following elements:

a unibody frame, consisting of two generally parabolically shaped horizontal upper and lower frame members held in parallel relation to one another by an obliquely angled transverse member, said transverse member having a relief machined into the interior face, said relief being aligned with the longitudinal axis of said transverse member, and a seat adjustment pin, said upper frame member further comprising of a head rest assembly, said head rest assembly containing a head rest, mobility controls and a device to facilitate the handing of medicinal supplies, a mobility means, said mobility means being within the control of the occupant of said device or by an external source of control, said means being attached to said lower frame member, a motion resistance means, said motion resistance means being constantly applied requiring positive displacement to variably relieve said means from applying resistance, said relieving of said resistance means allowing for movement of said device, said means being located through said mobility controls and secondarily located within control of occupant of said device, a ride comfort means, said ride comfort means being located about the vertical plane of the center of gravity of the occupant of said device, said device being rotatably mounted to said lower frame member and obliquely removeably attached to said transverse member, a detachable occupant restraint means, said detachable occupant restraint means capable of serving as a storage device, having food and beverage compartments, and providing a surface upon which to perform activities, said means interfacing with one of said frame members, an occupant accommodation means, said occupant accommodation means having two contoured surfaces, a lower contoured surface being pivotally attached to the back contoured surface in generally a perpendicular manner, said back surface containing supplemental relief attachment means, a foot rest pivotally attached to said lower frame member with means to prevent forward pivoting of said foot rest beyond parallel with said lower frame member, said pivoting means allowing for said foot rest to be pivoted beyond perpendicular when rotated rearwardly, and at least one material containment basket being attached to one of said frame members.

2. An Adult Multipurpose Mobility Device for the ambulatory assistance of those who are unable to travel without support due to physical, age or psychological reasons as in claim 1 where said mobility controls are rotatably mounted to said head rest assembly, said mobility control further comprising means to variably relieve the amount of resistance provided by said motion resistance means.

3. An Adult Multipurpose Mobility Device for the ambulatory assistance of those who are unable to travel without support due to physical, age or psychological reasons as in claim 1 where mobility means are wheels capable of rotation, said wheels being two front wheels and at least one rear wheel, said front wheels being larger in diameter than said at least one rear wheel and said front wheels are located forward of the center of gravity of the occupant, said at least one rear wheel being attached to said lower frame member in a manner to facilitate the rotation of said at least one rear wheel about an axis perpendicular to said lower frame member.

4. An Adult Multipurpose Mobility Device for the ambulatory assistance of those who are unable to travel without support due to physical, age or psychological reasons as in claim 1 where said motion resistance means consists of a disc rotor and disc pads attached to each of said front wheels, said disc pads are in pressurized contact with said rotor.

5. An Adult Multipurpose Mobility Device for the ambulatory assistance of those who are unable to travel without support due to physical, age or psychological reasons as in claim 1 where the means to variably relieve the amount of resistance provided by said motion resistance means is accomplished through caliper brake release levers.

6. An Adult Multipurpose Mobility Device for the ambulatory assistance of those who are unable to travel without support due to physical, age or psychological reasons as in claim 1 where the means to variably relieve the amount of resistance provided by said motion resistance means are located within the occupant's control.

7. An Adult Multipurpose Mobility Device for the ambulatory assistance of those who are unable to travel without support due to physical, age or psychological reasons as in claim 1 where said ride comfort means consists of a shock absorber, having a distal end capable of rotatably being attached to said lower frame member, and having a proximal end that contains a pin that interfaces with said relief in said transverse member, where said proximal end further has the means to disengage said pin from said relief allowing said device to collapse pivoting about the intersection of said lower frame member and said transverse member.

8. An Adult Multipurpose Mobility Device for the ambulatory assistance of those who are unable to travel without support due to physical, age or psychological reasons as in claim 1 where said detachable occupant restraint means is a polygonal shaped tray, having at least four sides, said tray having enough depth in order to facilitate indentions for various purposes, said tray sliding in coincidental relation to the open portion of said frame member, where detachable tray retention means consists of interfacing detents and intents located along said open portion of said frame member and said tray facilitating a capture of said tray on said frame member.

9. An Adult Multipurpose Mobility Device for the ambulatory assistance of those who are unable to travel without support due to physical, age or psychological reasons as in claim 1 further comprising a medical aid holder attached near the vertex of said upper frame member.

10. An Adult Multipurpose Mobility Device for the ambulatory assistance of those who are unable to travel without support due to physical, age or psychological reasons as in claim 1 where said occupant accommodation means facilitates the comfort of the occupant whilst physically sitting down in said device, where said lower contoured surface is cushioned and contains at least two slots therethrough to facilitate the addition of a securing strap or belt and said back contoured surface is cushioned and contains at least one though-slot, whereby devices such as lumbar or thoracic supports, pelvic or sacral bladders, are capable of being attached.

11. An Adult Multipurpose Mobility Device for the ambulatory assistance of those who are unable to travel without support due to physical, age or psychological reasons as in claim 10 where said lower contoured surface has an upper side, which the occupant sits upon and an underside, said underside further comprising of an adjustment means, said adjustment slot containing a horizontal slot with at least two adjustment stops, said adjustment stops sized to interface with said seat adjustment pin of said transverse member.

12. An Adult Multipurpose Mobility Device for the ambulatory assistance of those who are unable to travel without support due to physical, age or psychological reasons comprising of the following elements;

a unibody frame, consisting of two generally parabolically shaped horizontal upper and lower frame members held in parallel relation to one another by an obliquely angled transverse member, said transverse member having a relief machined into the interior face, said relief being aligned with the longitudinal axis of said transverse member, and a seat adjustment pin, said upper frame member further comprising of a medical aid holder attached near the vertex of said upper frame member and a head rest assembly, said head rest assembly containing a head rest, mobility controls rotatably mounted, and a device to facilitate the handing of medicinal supplies, a mobility means, said mobility means being within the control of the occupant of said device or by an external source of control, said means being attached to said lower frame member, a motion resistance means, said motion resistance means being constantly applied requiring positive displacement to variably relieve said means from applying resistance, said relieving of said resistance means allowing for movement of said device, said relieving means being located through said mobility controls and secondarily located within control of occupant of said device, a ride comfort means, said ride comfort means being located near the vertical plane of the center of gravity of the occupant of said device, said means being rotatably mounted to said lower frame member and obliquely removeably attached to said transverse member, a detachable occupant restraint means, said detachable occupant restraint means capable of serving as a storage device, having food and beverage compartments, and providing a surface upon which to perform activities, said means interfacing with one of said frame members, an occupant accommodation means, said occupant accommodation means having two contoured surfaces, a lower contoured surface being pivotally attached to the back contoured surface in generally a perpendicular manner, said back surface containing supplemental relief attachment means, a foot rest pivotally attached to said lower frame member with means to prevent forward pivoting of said foot rest beyond parallel with said lower frame member, said pivoting means allowing for said foot rest to be pivoted beyond perpendicular when rotated rearwardly, at least one material containment basket being attached to one of said frame members, and an environmental protection means, consisting of a flexible barrier and supporting structure, said supporting structure being capable of complete detachment from said upper frame member when not in use and said barrier being deployed is capable of extending from behind said head rest assembly, over said supporting frame, to be in contact with the underside of said foot rest.

13. An Adult Multipurpose Mobility Device for the ambulatory assistance of those who are unable to travel without support due to physical, age or psychological reasons as in claim 12 where mobility means are wheels capable of rotation, said wheels being two front wheels and at least one rear wheel, said front wheels being larger in diameter than said at least one rear wheel and said front wheels are located forward of the center of gravity of the occupant, said at least one rear wheel being attached to said lower frame member in a manner to facilitate the rotation of said at least one rear wheel about an axis perpendicular to said lower frame member.

14. An Adult Multipurpose Mobility Device for the ambulatory assistance of those who are unable to travel without support due to physical, age or psychological reasons as in claim 12 where said motion resistance means consists of a disc rotor and disc pads attached to each of said front wheels and said disc pads are in pressurized contact with said rotor.

15. An Adult Multipurpose Mobility Device for the ambulatory assistance of those who are unable to travel without support due to physical, age or psychological reasons as in claim 12 where means to variably relieve the amount of resistance provided by said motion resistance means is accomplished through caliper brake release levers.

16. An Adult Multipurpose Mobility Device for the ambulatory assistance of those who are unable to travel without support due to physical, age or psychological reasons as in claim 12 where means to variably relieve the amount of resistance provided by said motion resistance means are located within the occupant's control.

17. An Adult Multipurpose Mobility Device for the ambulatory assistance of those who are unable to travel without support due to physical, age or psychological reasons as in claim 12 where means to variably relieve the amount of resistance provided by said motion resistance means are located within the caregiver's control.

18. An Adult Multipurpose Mobility Device for the ambulatory assistance of those who are unable to travel without support due to physical, age or psychological reasons as in claim 12 where said ride comfort means consists of a shock absorber, having a distal end capable of rotatably being attached to said lower frame member, and having a proximal end that contains a pin that interfaces with said relief in said transverse member, where said proximal end further has the means to disengage said pin from said relief allowing said device to collapse pivoting about the intersection of said lower frame member and said transverse member.

19. An Adult Multipurpose Mobility Device for the ambulatory assistance of those who are unable to travel without support due to physical, age or psychological reasons as in claim 12 where said detachable occupant restraint means is a polygonal shaped tray, having at least four sides, said tray having enough depth in order to facilitate indentions for various purposes, said tray sliding in coincidental relation to the open portion of said frame member, where detachable tray retention means consists of interfacing detents and intents located along said open portion of said frame member and said tray facilitating a capture of said tray on said frame member.

20. An Adult Multipurpose Mobility Device for the ambulatory assistance of those who are unable to travel without support due to physical, age or psychological reasons as in claim 12 where said environmental protection means consists of a canopy, said environmental protection means further consists of a canopy frame having arcing members extending from the left and right side of said device, said canopy frame being removably attached to said upper frame member, said canopy being deployed over said canopy frame, said canopy being constructed of a breathable fabric with clear viewing portals.

21. An Adult Multipurpose Mobility Device for the ambulatory assistance of those who are unable to travel without support due to physical, age or psychological reasons as in claim 12 where said occupant accommodation means facilitates the comfort of the occupant whilst physically sitting down in said device, where said lower contoured surface is cushioned and contains at least two slots therethrough to facilitate the addition of a securing strap or belt and said back contoured surface is cushioned and contains at least one though-slot, whereby devices such as lumbar or thoracic supports, pelvic or sacral bladders, are capable of being attached.

22. An Adult Multipurpose Mobility Device for the ambulatory assistance of those who are unable to travel without support due to physical, age or psychological reasons as in claim 21 where said lower contoured surface has an upper side, which the occupant sits upon and an underside, said underside further comprising of an adjustment means, said adjustment slot containing a horizontal slot with at least two adjustment stops, said adjustment stops sized to interface with said seat adjustment pin of said transverse member.

23. An Adult Multipurpose Mobility Device for the ambulatory assistance of those who are unable to travel without support due to physical, age or psychological reasons as in claim 22 where said occupant accommodation means facilitates the comfort of the occupant whilst physically sitting down in said device, where said lower contoured surface is cushioned and contains at least two slots therethrough to facilitate the addition of a securing strap or belt and said back contoured surface is cushioned and contains at least one though-slot, whereby devices such as lumbar or thoracic supports, pelvic or sacral bladders, are capable of being attached.

24. An Adult Multipurpose Mobility Device for the ambulatory assistance of those who are unable to travel without support due to physical, age or psychological reasons as in claim 23 where said lower contoured surface has an upper side, which the occupant sits upon and an underside, said underside further comprising of an adjustment means, said adjustment slot containing a horizontal slot with at least two adjustment stops, said adjustment stops sized to interface with said seat adjustment pin of said transverse member.

25. An Adult Multipurpose Mobility Device for the ambulatory assistance of those who are unable to travel without support due to physical, age or psychological reasons comprising of the following elements;

a unibody frame, consisting of two generally parabolically shaped horizontal upper and lower frame members held in parallel relation to one another by an obliquely angled transverse member, said transverse member having a relief machined into the interior face, said relief being aligned with the longitudinal axis of said transverse member, and a seat adjustment pin, said upper frame member further comprising of a medical aid holder attached near the vertex of said upper frame member and a head rest assembly, said head rest assembly containing a head rest, mobility controls rotatably mounted, and a device to facilitate the handing of medicinal supplies, a mobility means, said mobility means being within the control of the occupant of said device or by an external source of control, said means being attached to said lower frame member, a motion resistance means, said motion resistance means being constantly applied requiring positive displacement to variably relieve said means from applying resistance, said relieving of said resistance means allowing for movement of said device, said relieving means being located through said mobility controls and secondarily located within control of occupant of said device, a ride comfort means, said ride comfort means being located near the vertical plane of the center of gravity of the occupant of said device, said means being rotatably mounted to said lower frame member and obliquely removeably attached to said transverse member, a detachable occupant restraint means, said detachable occupant restraint means capable of serving as a storage device, having food and beverage compartments, and providing a surface upon which to perform activities, said means interfacing with one of said frame members, an occupant accommodation means, said occupant accommodation means having two contoured surfaces, a lower contoured surface being pivotally attached to the back contoured surface in generally a perpendicular manner, said back surface containing supplemental relief attachment means, a foot rest pivotally attached to said lower frame member with means to prevent forward pivoting of said foot rest beyond parallel with said lower frame member, said pivoting means allowing for said foot rest to be pivoted beyond perpendicular when rotated rearwardly, and at least one material containment basket being attached to one of said frame members.

26. An Adult Multipurpose Mobility Device for the ambulatory assistance of those who are unable to travel without support due to physical, age or psychological reasons as in claim 25 where mobility means are wheels capable of rotation, said wheels being two front wheels and at least one rear wheel, said front wheels being larger in diameter than said at least one rear wheel and said front wheels are located forward of the center of gravity of the occupant, said at least one rear wheel being attached to said lower frame member in a manner to facilitate the rotation of said at least one rear wheel about an axis perpendicular to said lower frame member.

27. An Adult Multipurpose Mobility Device for the ambulatory assistance of those who are unable to travel without support due to physical, age or psychological reasons as in claim 25 where said motion resistance means consists of a disc rotor and disc pads attached to each of said front wheels and said disc pads are in pressurized contact with said rotor.

28. An Adult Multipurpose Mobility Device for the ambulatory assistance of those who are unable to travel without support due to physical, age or psychological reasons as in claim 25 where means to variably relieve the amount of resistance provided by said motion resistance means is accomplished through caliper brake release levers.

29. An Adult Multipurpose Mobility Device for the ambulatory assistance of those who are unable to travel without support due to physical, age or psychological reasons as in claim 28 where means to variably relieve the amount of resistance provided by said motion resistance means are located within the occupant's control.

30. An Adult Multipurpose Mobility Device for the ambulatory assistance of those who are unable to travel without support due to physical, age or psychological reasons as in claim 28 where means to variably relieve the amount of resistance provided by said motion resistance means are located within the caregiver's control.

31. An Adult Multipurpose Mobility Device for the ambulatory assistance of those who are unable to travel without support due to physical, age or psychological reasons as in claim 25 where said ride comfort means consists of a shock absorber, having a distal end capable of rotatably being attached to said lower frame member, and having a proximal end that contains a pin that interfaces with said relief in said transverse member, where said proximal end further has the means to disengage said pin from said relief allowing said device to collapse pivoting about the intersection of said lower frame member and said transverse member.

32. An Adult Multipurpose Mobility Device for the ambulatory assistance of those who are unable to travel without support due to physical, age or psychological reasons as in claim 25 where said detachable occupant restraint means is a polygonal shaped tray, having at least four sides, said tray having enough depth in order to facilitate indentions for various purposes, said tray sliding in coincidental relation to the open portion of said frame member, where detachable tray retention means consists of interfacing detents and intents located along said open portion of said frame member and said tray facilitating a capture of said tray on said frame member.

33. An Adult Multipurpose Mobility Device for the ambulatory assistance of those who are unable to travel without support due to physical, age or psychological reasons as in claim 25 where said mobility means includes a ratcheting power arm having a proximal end and a distal end, said distal end interfacing to the hub of said front wheel, said arm extending from said hub to a location where occupant is able to apply a lever force thereupon, said proximal end having a biasing switch, said biasing switch reversing the bias of the ratchet allowing for motion in both forward and reverse modes.

* * * * *